US008797183B2

(12) United States Patent
Burton et al.

(10) Patent No.: US 8,797,183 B2
(45) Date of Patent: Aug. 5, 2014

(54) INTEGRATED SIGNAL LIGHT HEAD

(75) Inventors: Thomas R. Burton, Germantown, TN (US); John H. Vines, Toms River, NJ (US); Richard Liskoff, Manasquan, NJ (US); John Patrick Peck, Manasquan, NJ (US)

(73) Assignee: Dialight Corporation, Farmingdale, NJ (US)

( * ) Notice: Subject to any disclaimer, the term of this patent is extended or adjusted under 35 U.S.C. 154(b) by 366 days.

(21) Appl. No.: 12/887,058

(22) Filed: Sep. 21, 2010

(65) Prior Publication Data

US 2012/0069561 A1 Mar. 22, 2012

(51) Int. Cl.

| | |
|---|---|
| ***G08G 1/095*** | (2006.01) |
| ***E01F 9/00*** | (2006.01) |
| ***G08G 1/0955*** | (2006.01) |
| *F21W 111/02* | (2006.01) |
| *F21S 8/10* | (2006.01) |

(52) U.S. Cl.

CPC ..... *G08G 1/095* (2013.01); *G08G 1/0955* (2013.01); *F21W 2111/02* (2013.01); *F21S 8/10* (2013.01)

USPC ..... 340/907; 116/63 R; 362/231

(58) Field of Classification Search

CPC ..... G08G 1/095–1/0955; F21S 8/085–8/088; F21W 2111/02–2111/027

USPC ..... 362/231; 116/63 R; 340/907

See application file for complete search history.

(56) References Cited

U.S. PATENT DOCUMENTS

| | | | | |
|---|---|---|---|---|
| 2,967,293 | A | 1/1961 | Paulson | |
| 3,030,165 | A * | 4/1962 | Nagy | 312/311 |
| 4,075,402 | A | 2/1978 | Okamoto | |
| 5,010,336 | A * | 4/1991 | Mosele et al. | 340/907 |
| 5,633,629 | A * | 5/1997 | Hochstein | 340/907 |
| 5,664,874 | A | 9/1997 | Winterer | |
| 6,107,941 | A * | 8/2000 | Jones | 340/915 |
| 6,459,175 | B1 | 10/2002 | Potega | |
| 6,522,263 | B2 * | 2/2003 | Jones | 340/915 |
| 7,307,546 | B1 * | 12/2007 | Partap | 340/907 |
| 7,385,481 | B2 * | 6/2008 | Sommers et al. | 340/321 |
| 7,586,421 | B2 * | 9/2009 | Witte et al. | 340/908 |
| 7,671,760 | B2 * | 3/2010 | Vallejo, Sr. | 340/907 |
| 7,733,242 | B2 * | 6/2010 | Bertels et al. | 340/926 |
| 7,976,180 | B1 * | 7/2011 | Haun et al. | 362/183 |
| 8,295,059 | B1 * | 10/2012 | Conroy | 361/796 |
| 2002/0027510 | A1 * | 3/2002 | Jones et al. | 340/907 |

(Continued)

FOREIGN PATENT DOCUMENTS

| | | |
|---|---|---|
| AT | 505 154 | 11/2008 |
| EP | 2 211 385 | 7/2010 |
| WO | WO 2011/032219 A1 | 3/2011 |

OTHER PUBLICATIONS

International Search Report and Written Opinion for PCT/US2011/023579, Mar. 30, 2011, consists of 8 pages.

(Continued)

*Primary Examiner* — David J Makiya

(57) ABSTRACT

The present disclosure relates generally to an integrated signal light head. In one embodiment, the integrated signal light head includes a molded housing for holding at least one light emitting diode (LED) light source and a power supply compartment coupled to the molded housing. As a result, a power supply may be remotely located and independent of the at least one LED light source.

14 Claims, 5 Drawing Sheets

(56) References Cited

U.S. PATENT DOCUMENTS

| | | | | |
|---|---|---|---|---|
| 2004/0120152 | A1 | 6/2004 | Bolta et al. | |
| 2006/0039150 | A1 | 2/2006 | Mayer et al. | |
| 2007/0139921 | A1 | 6/2007 | Wu | |
| 2007/0290887 | A1 * | 12/2007 | Pleasanton | 340/908 |
| 2008/0129543 | A1 | 6/2008 | Lee | |
| 2008/0150757 | A1 * | 6/2008 | Hutchison | 340/907 |
| 2009/0154171 | A1 | 6/2009 | Xiao | |
| 2010/0026520 | A1 * | 2/2010 | Witte et al. | 340/908 |
| 2010/0187549 | A1 | 7/2010 | Chen | |
| 2012/0069561 | A1 | 3/2012 | Burton et al. | |

OTHER PUBLICATIONS

International Search Report and Written Opinion for International Patent Application Serial No. PCT/US2013/054351, mailed Aug. 19, 2013, consists of 11 unnumbered pages.

Supplemental European Search Report EP 11 82 7107,Feb. 24, 2014, consists of 6 pages.

* cited by examiner

INTEGRATED SIGNAL LIGHT HEAD

BACKGROUND

Previous signal light heads, such as traffic lights, were designed for incandescent light sources. However, signal light heads have been transitioning to a light emitting diode (LED) based light source. As a result, the incandescent-based signal light heads must be retrofitted with an LED-based light module.

In addition, previous incandescent-based signal light heads were designed to include a set of components including a reflector, socket, a hinge, and a locking mechanism. These components may be removed and the signal head may be retrofitted with an LED-based light module. A power source for each traffic signal light is contained in the individual LED-based light modules. The power source typically converts the high-voltage AC line input to a low-voltage DC output for the LEDs. The power source is located inside the LED-based light module. In the event of a failure of the power source the entire LED-based light module must be removed and replaced. Consequently, the rest of the LED-based light module, including the LEDs, the housing, wiring, connectors, and the lenses would be wasted to simply replace a power supply.

SUMMARY

The present disclosure relates generally to an integrated signal light head. In one embodiment, the integrated signal light head comprises a molded housing for holding at least one light emitting diode (LED) light source and a power supply compartment coupled to the molded housing.

The present invention also provides an integrated traffic signal light head. In one embodiment, integrated traffic signal light head comprises a molded housing for holding at least one light emitting diode (LED) based traffic signal light, wherein the at least one LED based traffic signal light is powered by a remotely located power supply and a power supply compartment coupled to the molded housing.

The present invention also provides a second embodiment for an integrated signal light head. In one embodiment, the integrated signal light head comprises a molded housing for holding at least one light emitting diode (LED) based traffic signal light and a power supply compartment coupled to the molded housing, wherein the power supply compartment includes at least one receptacle for receiving a plug-and-play power supply.

BRIEF DESCRIPTION OF THE DRAWINGS

So that the manner in which the above recited features of the present invention can be understood in detail, a more particular description of the invention may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures.

DETAILED DESCRIPTION

Embodiments of the present disclosure are directed towards an integrated signal light head. As noted above, previous signal light heads have been retrofitted with LED-based light modules connected to a housing. However, when the power supply would fail, the entire module would need to be replaced. In the case of the incandescent light source, no power supply was needed so only the bulb was replaced.

However, in the case of the LEDs, the life of the LED light source is much greater than the life of the power supply. As a result, the chances of simply having to replace the power supply will be greater with LED based signal light heads. With the current design, replacing a complete LED traffic signal module due to a failure of the power supply is wasteful because other components, which may still be fully functional, are discarded simply to replace a failed power supply.

In addition, in an LED-based light module that was retrofitted into a signal head traditionally used for incandescent light bulbs, the signal head would include components such as a main housing, a door, a gasket, a hinge, a fastener, a terminal block and wiring. In addition, due to the retrofitting an air gap would exist inside the housing between the LED of the retrofitted module and the housing. The air gap was undesirable due to its insulating effects that prevented heat to dissipate away from the LED.

By creating an integrated signal light head that has a remotely located power supply compartment, many of the components from the retrofitted design could be eliminated. In addition, the undesirable air gap could also be removed.

Figure 1:
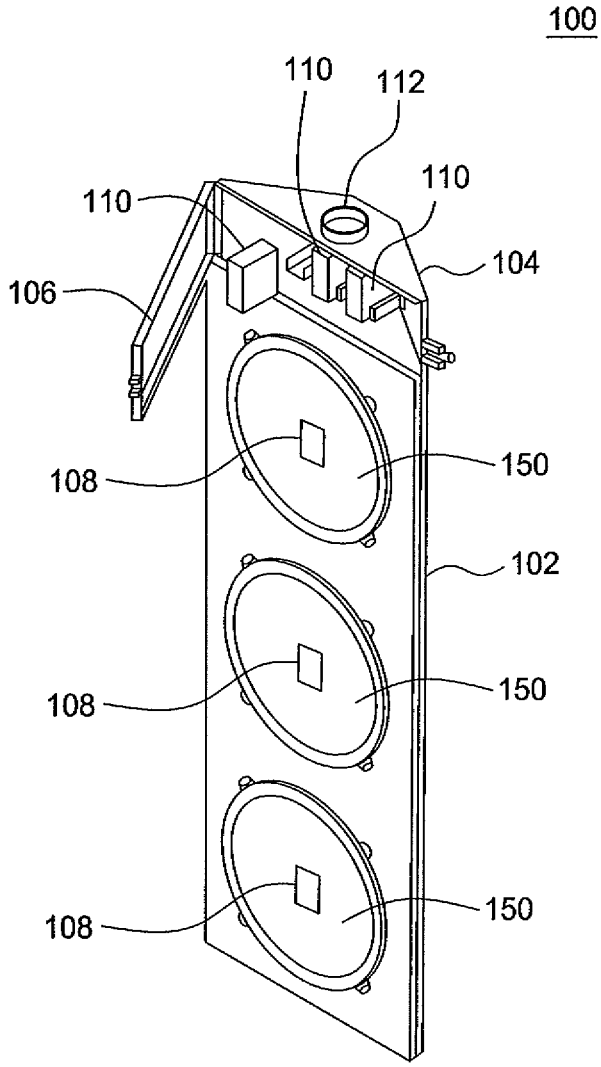
FIG. 1 depicts an isometric view of one embodiment of an integrated signal light head.

FIG. 1 illustrates an embodiment of an integrated signal light head 100. Although the integrated signal light head 100 is illustrated by example as a traffic signal light head, it should be noted that the integrated signal light head may be designed specifically for other applications as well, such as rail lighting, subway lighting, interior lighting fixtures and the like.

In one embodiment, the integrated signal light head 100 includes a molded housing 102 for holding at least one light source 108. In one embodiment, the light source 108 may be one or more LED light sources. The molded housing 102 may also include an outer lens 150 for each light source 108. In one embodiment, the outer lens 150 may be extruded as part of the molded housing 102. That is, the outer lens 150 does not have to be a separately attached lens. In one embodiment, the outer lens 150 may be used to spread the light to a desired distribution, thus eliminating the need for an inner Fresnel lens.

In one embodiment, the at least one light source 108 is located on an inside portion of the molded housing 102 and the outside of the molded housing 102 is exposed to outside air. In other words, the light source 108 is located on the inside portion of the molded housing 102 and an outside portion of the molded housing 102 directly opposite the light source 108 is exposed to outside air. This may improve the cooling to the at least one light source 108 by eliminating an insulating air pocket that existed between the housing and the retrofitted LED-based light module used in previous designs. Outside air may be defined as ambient air outside of any enclosures, building, etc.

Figure 4:
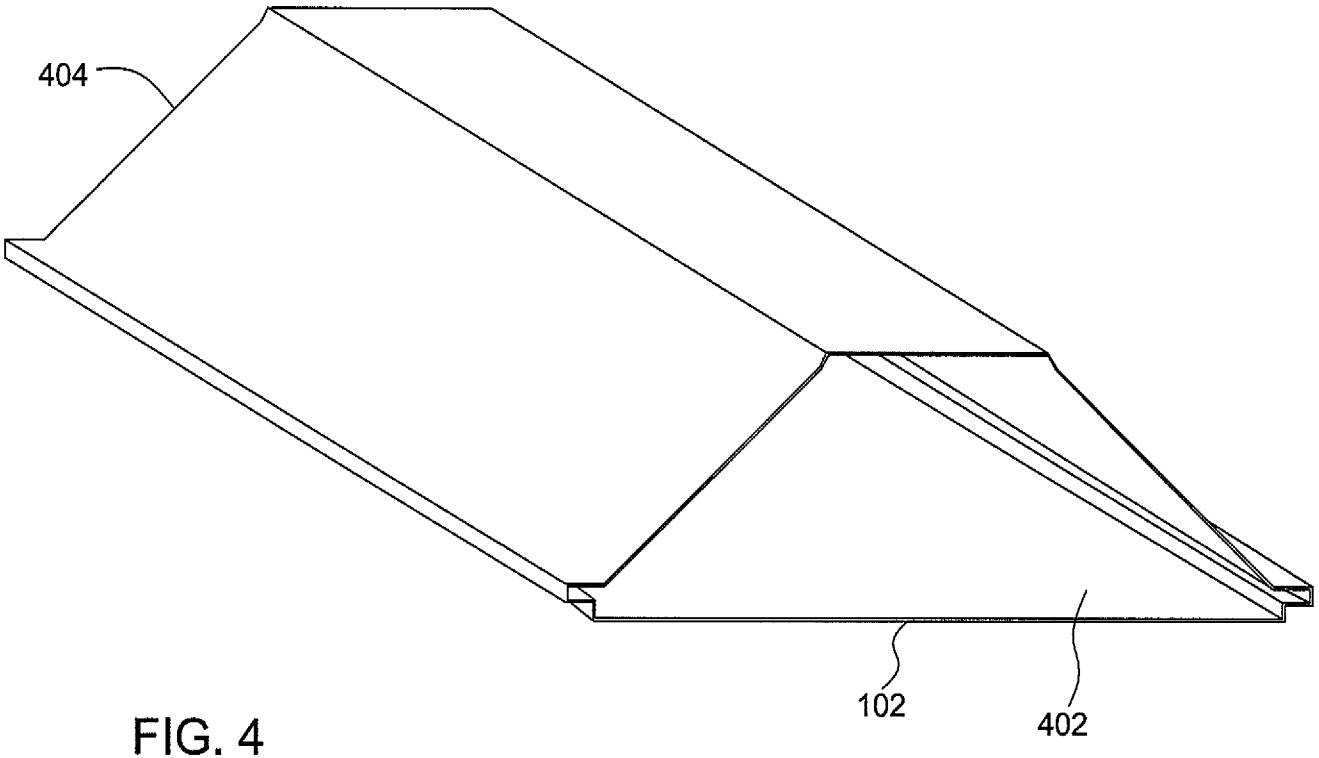
FIG. 4 depicts an isometric view of a molded housing.

In a further embodiment, the molded housing 102 may be fabricated using methods other than standard molding. For example, the molded housing 102 can consist of an extruded portion as shown in FIG. 4. A top opening 402 and a bottom opening 404 may be closed off with end pieces (not shown). In a further embodiment, the top opening 402 and the bottom opening 404 may be fully open.

The light source 108 may also include other optical or mechanical features not shown. For example, the light source 108 may have a heat sink integrated into the molded housing 102 to dissipate heat away from the light source 108. In addition, the light source 108 may include a reflector to direct the light towards the outer lens 150. These additional features may be installed inside the molded housing 102.

Figure 5:
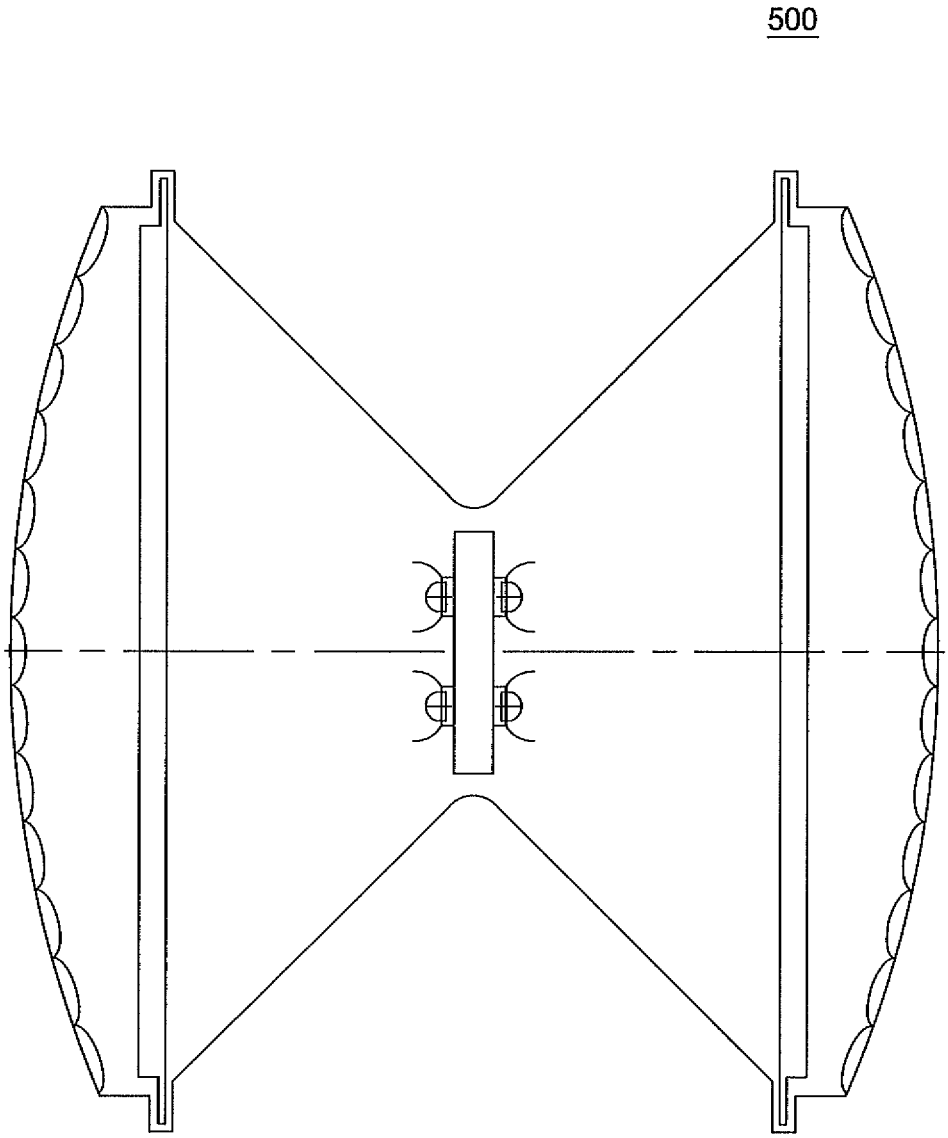
FIG. 5 depicts one example of a 2-way signal light.

In addition, it should be noted that although an integrated signal light head 100 having three light sources 108 is illustrated, any number of light sources 108 and any configuration of light sources 108 may be used. For example, a single light source 108 may be used for an integrated signal light head 100 and multiple integrated signal light heads 100 may be coupled together. In addition, the light sources 108 may be aligned vertically as illustrated in FIG. 1 or oriented horizontally. In addition, the molded housing 102 may be designed as multiple modules instead of a single module shown in FIG. 1. For example, there may be a power supply module and three light engine modules. The light engine modules may be designed to work in a nesting configuration. In addition, multiple integrated signal light heads 100 may be coupled together to form 2-way signal light 500 for each direction of a 2-way intersection as shown in the top view illustration of FIG. 5. In a further embodiment, multiple integrated signal light heads 100 may be coupled together to form a 4-way signal light for each direction of a 4-way intersection. The number of light sources 108 and configurations described above or only provided as examples and should not be considered limiting.

In one embodiment, the integrated signal light head 100 includes a mating surface 112. The mating surface 112 may be a universal mount that fits any pole or mounting surface associated with a particular application (e.g. a traffic light pole, a train rail, coupling for the 4-way signal light configuration, etc.).

The molded housing 102 may be coupled to a power supply compartment 104. In one embodiment, the power supply compartment 104 and the molded housing 102 may be molded as a single piece. The power supply compartment 104 and the molded housing 102 may comprise a plastic or metal.

The power supply compartment 104 includes a door 106. The door 106 may be sealed to prevent moisture from entering the power supply compartment 104 and protecting the interior of the power supply compartment 104 from inclement weather.

One or more power supplies 110 may be plugged in the power supply compartment 104. The one or more power supplies 110 are located remotely from the at least one light source 108 and power the at least one light source 108. The one or more power supplies 110 are plug-and-play. That is, the power supply 110 does not require any setup or wiring. To replace a power supply 110, a technician is simply required to pull out an old power supply and plug in a new power supply.

In one embodiment, the power supply compartment 104 may include one power supply 110 for a plurality of light sources. For example, if the integrated signal light head 100 includes a red light, a yellow light and a green light, a single power supply 110 may be programmed to power all three lights, but not necessarily at the same time.

In another embodiment, the power supply compartment 104 may include a plurality of power supplies 110. For example, if the integrated signal light head 100 includes a red light, a yellow light and a green light, the power supply compartment 104 may include three or more power supplies 110 (i.e. at least one power supply 110 for each light color).

The power supply compartment 104 may also include back up power supplies. For example one or more of the power supplies 110 may be back up or redundant power supplies.

As a result, the power supply 110 of the integrated signal light head 100 may be replaced more easily and efficiently than in prior designs. In prior designs, a technician may have had to access the power supply within a module that could be removed from the housing. This was a very difficult and laborious process.

In contrast, the novel design of the present integrated signal light head 100 allows the power supply 110 to be easily accessed without requiring removal of any modules in the housing. In other words, the power supply 110 may be removed independent of the at least one light source 108. That is, the power supply 110 may be replaced without replacing the at least one light source 108 that may still be functioning or have many years of life left. As a result, to replace the power supply 110 in the integrated signal light head 100, a technician simply needs to open the door 106 of the power supply compartment 104 to remove the old power supply 110 and insert a new power supply 110.

In addition, the novel design of the present integrated signal light head 100 provides cost savings. In previous designs, if the power supply could not be replaced, then the entire module including the light source would need to be replaced. This would waste a functioning light source due to the failure of the power supply. This would surely be the case when the integrated signal light head 100 uses LED based light sources 108 that may last many years beyond the life of the power supply 110. However, the present design allows the power supply 110 to be replaced without requiring replacement of the light source 108.

Additional cost savings are achieved due to the smaller size and weight of the integrated signal light head 100. Due to the use of LED based light sources 108 and elimination of the need to remove modules, less materials are used. For example, the previous design required multiple seals for each of the modules that were fitted to the signal head. The present design only requires a single seal. In addition, the integrated signal light head 100 requires less cost to manufacture due to the single molded housing that does not require installation of the separate modules of the previous designs.

The costs savings of the smaller size and weight is further propagated throughout the rest of the system. For example, for traffic signals, the mounting poles can be smaller and lighter and cabling used can be smaller and lighter. The use of LED based light sources 108 may allow the power supply 110 to be a 24-48 volt power supply. As a result, the design of the integrated signal light head 100 achieves substantial cost savings and efficiencies.

Figure 2:
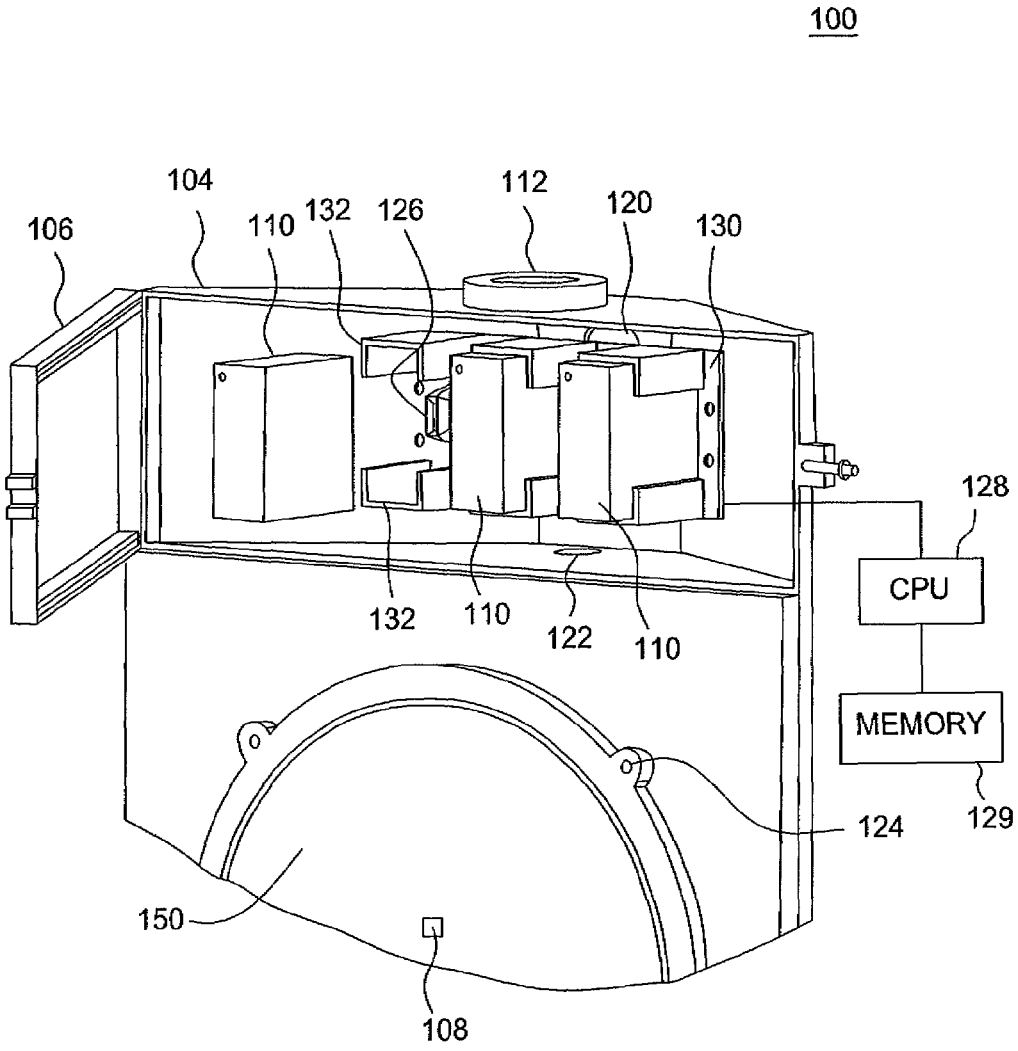
FIG. 2 depicts an enlarged view of a power supply compartment of the integrated signal light head.

FIG. 2 illustrates an enlarged view of the power supply compartment 104 of the integrated signal light head 100 as well as other features. As noted above, the one or more power supplies 110 are "plug and play". The power supply compartment 104 includes one or more guides 132 for aligning the power supply 110 to a female plug 126 that is coupled to a circuit board 130.

In one embodiment, the power supply compartment 104 may incorporate a secondary locking feature (not shown), e.g., a clasp, a locking tab, etc., to prevent the power supply 110 from being disconnected from the female plug 126 when exposed to vibration. In addition, the configuration of the power supply compartment 104 and the door 106 may be such that when the door 106 is closed it will provide a means of securing the power supply in place to prevent a disconnection of the power supply 110 from the female plug 126 when exposed to vibration. For example, the door 106 may be fitted with guides that "hug" the power supply 110 in place when the door 106 is closed or the door 106 may have a raised portion that "pushes" the power supply 110 into the female plug 126 when closed.

In addition, the circuit board 130 may include a processor (e.g. a central processing unit (CPU)) or an ASIC controller 128 and a computer readable storage medium or memory 129 (e.g. RAM, ROM, hard disk drive, flash drive and the like) for controlling operation of the one or more power supplies 110. For example, logic for controlling the operation of the one or more power supplies 110 may be stored in the memory 129 and executed by the processor 128.

As noted above, various configurations of the one or more power supplies 110 can be employed. In one embodiment, if a single power supply 110 is used to power a plurality of light sources 108, a program code may be stored in the memory 129 that diverts the power supply from a red light source to a green light source after a predetermined period of time. This logic would allow a single power supply 110 to be used, thereby providing additional costs savings by reducing the number of required power supplies 110 and reducing the overall weight of the integrated signal light head 100. The processor 128 may call the program code in memory 129 to execute the program code.

In other embodiments, a program code can be written to instruct the integrated signal light head 100 to divert to a back-up power supply 110 when a primary power supply 110 fails. For example, the program code could continually monitor a power level of the primary power supply 110 and switch over to the back-up power supply 110 if the power level fell below a predetermined threshold, e.g. 10 percent.

In addition, the program code executed by the processor may provide an indication that a power supply needs to be replaced. For example, an indicator light on the power supply 110 or in the power supply compartment 104 may change from a green color to a red color. Alternatively, the power supply compartment 104 may be equipped with a wireless transmitter that may transmit a wireless signal to a technician to indicate that a power supply 110 needs to be replaced if the power level falls below the predetermined threshold.

The examples provided above are only illustrative examples and should not be considered limiting. It should be noted that any type of logic needed to implement any configuration of the power supplies 110 may be stored in the memory 129 and executed by the processor 128.

The power supply compartment 104 may also include one or more sealed wiring cavities 120 and 122. The sealed wiring cavity 120 is to the outside and the sealed wiring cavity 122 is to the light compartment or the extruded molding 102. For example, the circuit board 130 may be wired to the light source 108 via the sealed wiring cavity 122. In addition, the control of the light source 108 and the one or more power supplies 110 may be controlled by an external controller. As a result, the circuit board 130 may be coupled to an external controller via the sealed wiring cavity 120.

The integrated signal light head 100 may also include mounting holes 124 on the outer lenses 150. The mounting holes 124 may be used to couple attachments onto the outer lens 150. For example, visors for traffic signal lights may be coupled to the outer lens 150 via the mounting holes 124.

Figure 3:
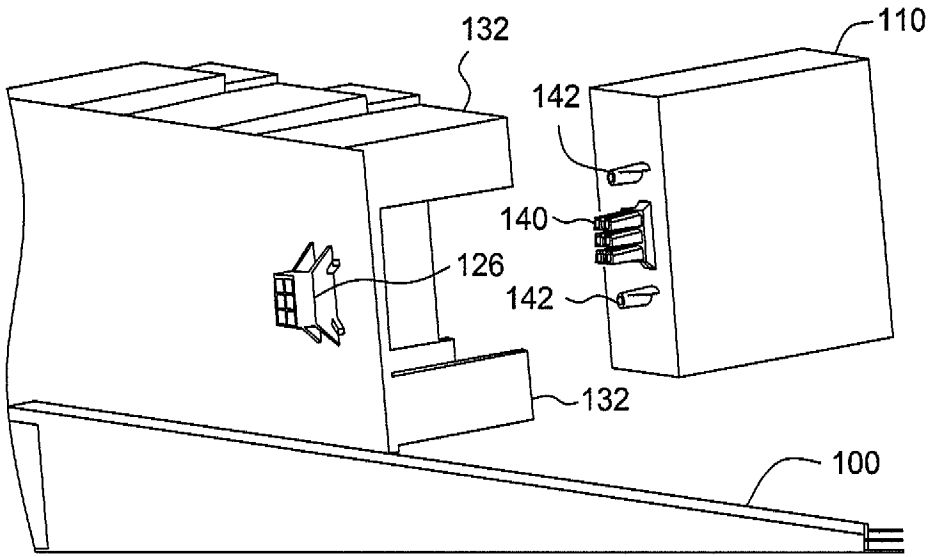
FIG. 3 depicts an enlarged view of connections of a power supply.

FIG. 3 illustrates an enlarged view of connections of the power supply 110. Each power supply 110 may include a male plug 140 and alignment pins 142. The alignment pins 142 in conjunction with the guides 132 allow the power supply 110 to be easily inserted into the female plug 126. The alignment pins 142 also provide additional support to prevent most of the weight of the power supply 110 from being applied to the male plug 140.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. An integrated signal light head, comprising:

a molded housing for holding a plurality of light emitting diode (LED) light sources, wherein the molded housing comprises a mating surface for mounting the integrated signal light head; and a power supply compartment coupled to the molded housing, wherein said power supply compartment is located remotely from the plurality of LED light sources and comprises a door to access at least one power supply inside the power supply compartment without requiring removal of any of the plurality of LED light sources, wherein the molded housing and the power supply compartment are molded as a single piece.

2. The integrated signal light head of claim 1, wherein the plurality of LED light sources is located on an inside portion of the molded housing and an outside portion of the molded housing directly opposite the plurality of LED light sources is exposed to outside air.

3. The integrated signal light head of claim 1, wherein the at least one power supply is a plug-and-play power supply.

4. The integrated signal light head of claim 3, wherein the at least one power supply is replaceable independent of the plurality of LED light sources.

5. The integrated signal light head of claim 1, wherein the at least one power supply comprises a single power supply that powers each one of the plurality of LED light sources.

6. The integrated signal light head of claim 1, wherein the at least one power supply comprises a power supply for each one of the plurality of LED light sources.

7. An integrated traffic signal light head, comprising:

a molded housing for holding a plurality of light emitting diode (LED) based traffic signal lights, wherein the plurality LED based traffic signal lights are powered by a remotely located power supply, wherein the molded housing comprises a mating surface for mounting the integrated traffic signal light head; and a power supply compartment coupled to the molded housing, wherein said power supply compartment is located remotely from the plurality LED based traffic signal lights and comprises a door to access the remotely located power supply inside the power supply compartment without requiring removal of any of the plurality of LED based traffic signal lights, wherein the molded housing and the power supply compartment are molded as a single piece.

8. The integrated traffic signal light head of claim 7, wherein the plurality LED based traffic signal lights comprises a red colored LED, a yellow colored LED and a green colored LED.

9. The integrated traffic signal light head of claim 7, wherein the remotely located power supply is plug-and-play.

10. The integrated traffic signal light head of claim 7, wherein the remotely located power supply comprises a single power supply that powers each one of the plurality of LED based traffic signal lights.

11. The integrated traffic signal light head of claim 7, wherein the remotely located power supply comprises a power supply for each one of the plurality of LED based traffic signal lights.

12. An integrated signal light head, comprising:

a molded housing for holding a plurality of light emitting diode (LED) based traffic signal lights, wherein the molded housing comprises a mating surface for mounting the integrated signal light head; and a power supply compartment coupled to the molded housing, wherein the power supply compartment includes at least one female plug for receiving a plug-and-play power supply, wherein said power supply compartment is located remotely from the plurality of LED based traffic signal lights and comprises a door to access the plug-and-play power supply inside the power supply compartment without requiring removal of any of the plurality of LED based traffic signal lights, wherein the molded housing and the power supply compartment are molded as a single piece.

13. The integrated signal light head of claim 12, wherein the plug-and-play power supply comprises a single power supply that powers each one of the plurality of LED based traffic signal lights.

14. The integrated traffic signal light head of claim 12, wherein the plug-and-play power supply comprises a power supply for each one of the plurality of LED based traffic signal lights.

* * * * *

UNITED STATES PATENT AND TRADEMARK OFFICE

CERTIFICATE OF CORRECTION

PATENT NO. : 8,797,183 B2
APPLICATION NO. : 12/887058
DATED : August 5, 2014
INVENTOR(S) : Thomas R. Burton et al.

It is certified that error appears in the above-identified patent and that said Letters Patent is hereby corrected as shown below:

Claims

Column 6, line 44-45, In Claim 7, delete "plurality LED" and insert -- plurality of LED --, therefor.

Column 6, line 51, In Claim 7, delete "plurality LED" and insert -- plurality of LED --, therefor.

Column 6, line 59, In Claim 8, delete "plurality LED" and insert -- plurality of LED --, therefor.

Signed and Sealed this
Twelfth Day of January, 2016

Michelle K. Lee

Michelle K. Lee
*Director of the United States Patent and Trademark Office*